United States Patent [19]

Asaka et al.

[11] Patent Number: 4,539,197

[45] Date of Patent: Sep. 3, 1985

[54] PROCESS FOR MAKING SINTERED COMPOSITE MECHANICAL PARTS

[75] Inventors: Kazuo Asaka; Takashi Koyama, both of Chiba, Japan

[73] Assignee: Hitachi Powdered Metals Co., Ltd., Chiba, Japan

[21] Appl. No.: 511,493

[22] Filed: Jul. 7, 1983

[30] Foreign Application Priority Data

Jul. 13, 1982 [JP] Japan ..... 57-121813

[51] Int. Cl.[3] ..... B22F 3/00

[52] U.S. Cl. ..... 419/6; 419/38; 148/126.1; 148/127; 228/131

[58] Field of Search ..... 419/5, 6, 38; 148/126.1, 127; 228/131

[56] References Cited

FOREIGN PATENT DOCUMENTS

| | | | |
|---|---|---|---|
| 2632479 | 1/1978 | Fed. Rep. of Germany | 419/5 |
| 166307 | 12/1981 | Japan | 419/6 |
| 89412 | 6/1982 | Japan | 419/5 |
| 801987 | 2/1981 | U.S.S.R. | 419/5 |

OTHER PUBLICATIONS

Modern Metals, Jun. 1976, p. 37.

*Primary Examiner*—Stephen J. Lechert, Jr.
*Attorney, Agent, or Firm*—Burgess, Ryan & Wayne

[57] ABSTRACT

A process for making a sintered mechanical part with a complex profile by preparing separately a compact having a shaft (referred to as the inner compact) and a compact having an opening (hereinafter referred to as the outer compact) by the compression of iron-based metal powders, and sintering both compacts in a state where the inner compact is fitted into the cutter compact, wherein a difference in fitting size between the shaft and the opening is selected such that interference fitting takes place with the interference being fixed at a value equal to, or lower than, the figure determined by the following calculation:

$$((0.23T+1)D+13.8)/300$$

wherein D and T are respectively the inner diameter and thickness, both in millimeter, of the outer part, and the inner part is inserted into the outer part by press fitting.

2 Claims, 5 Drawing Figures

PROCESS FOR MAKING SINTERED COMPOSITE MECHANICAL PARTS

BACKGROUND OF THE INVENTION

The present invention is concerned with improvements in or relating to the so-called green assembly process for joining together a plurality of green compacts into one sintered piece.

The conventional processes for making a mechanical part of a complicated profile comprises preparing separately a green compact having a projection or shaft (hereinafter referred to as the inner part) and a green compact having therein an associated recess or opening (hereinafter called the outer part) and fitting the shaft of the inner part into the associated opening of the outer part followed by sintering.

In accordance with such processes, the fitting of the inner part into the associated outer part is effected by the so-called shrink fit wherein an interference, viz., a difference in fitting size between the shaft and the opening, is fixed at a certain value resulting in interference fit, and the outer part is heated to expand the inner diameter thereof and fitted with the inner part in the thus expanded sate.

However, if the interference is too large, one would experience difficulty in the proper determination thereof due to the limited joining strength of the sintered body consisting of the inner and outer parts. This is also true where the interference is too small. Thus, there has been available only a limited interference.

SUMMARY OF THE INVENTION

According to one aspect of the present invention accomplished under such circumstances, a difference in fitting size between the shaft and the opening is selected such that interference fitting takes place with the interference being fixed at a value equal to, or lower than, the figure determined by the following calculation:

$$((0.23T+1)D+13.8)/300$$

wherein D and T are respectively the inner diameter and thickness, both in millimeter, of the outer part, and the inner part is inserted into the outer part by press fitting.

BRIEF DESCRIPTION OF THE DRAWINGS

Other aspects and features of the present invention will become apparent from the following detailed description with reference to the accompanying drawings, in which.

DETAILED EXPLANATION OF THE PREFERRED EMBODIMENTS

Considerable care should be paid to break-out or rupture of the outer part by press fitting since, according to the present invention, the shaft is inserted under pressure into the opening of the outer part which is still unsintered and, hence, has a low strength, contrary to the prior art technique.

For that reason, preliminary testing was carried out with respect to the relationship between the rupture of the outer part and the press fitting prior to the subject experiments.

Preliminary Testing 1

With powdery mixtures of atomized iron powders with 1,5% of copper powders and 0.7% of graphite powders, hollow, cylindrical compacts of the following dimensions were prepared. The compacts all had a density of 6.7 grams/cm$^2$.

inner diameter: 20 mm, thickness: 3, 5, 10 mm
inner diameter: 30 mm, thickness: 2, 3, 5, 10 mm
axial length: 5 mm (common to all the compacts)

With a material testing machine, a tapered pin having a taper of 5° was inserted under increasing load into each compact. The load applied to the tapered pin was measured the moment that the compact broke, and the thus obtained measurement was taken as the breaking load of the compact by press fitting.

Figure 1:
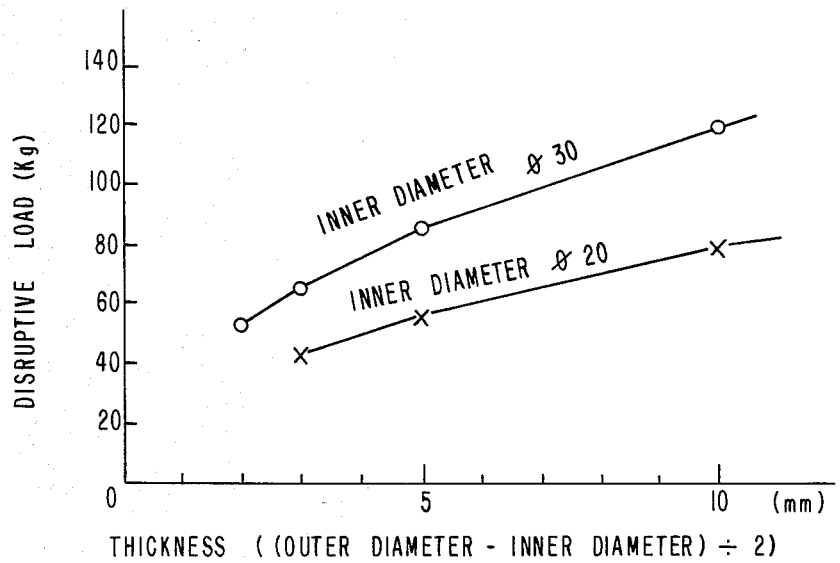
FIG. 1 is a graphical view showing the relationship between the thickness and the disruptive strength of green compacts having varied openings with varied diameters, when tapered pins are inserted under pressure thereinto.

The data obtained in this manner are graphically given in FIG. 1, from which it is found that:

1. Given the constant diameter of the openings, the thickness of the compacts correlates approximately primarily to the disruptive strength thereof; and 2. Given the constant thickness of the compacts, the rupture strength of the compacts is substantially proportional to the diameter of the openings thereof; in the case of the hollow, cylindrical compacts formed of the same materials and having the same density, the figures obtained by dividing the rupture strength by the circumference of the openings (strength per unit length of the circumference) become substantially equal.

From the thus obtained data, a disruptive strength P in kg is expressed in terms of an approximation equation $P=0.23D\ T+D+13.8$, wherein T and D are respectively the inner diameter and thickness, both in millimeter, of the outer parts.

Preliminary Testing 2

A compact having an inner diameter of 30 mm and a thickness of 5 mm was used as a typical example of the aforesaid compacts. The tapered pin as used in Testing 1 was inserted under pressure into the opening thereof to expand the inner diameter thereof. In this way, the relationship between the load applied to the tapered pin and the amount of expansion of the opening was then measured.

The amount of expansion of the inner diameter is described as an amount of inevitable expansion obtained in the insertion of the inner shaft into the outer opening under pressure and, in that sense, may be called an interference for press fitting. In view of interference fitting, however, it may be referred to as an interference for interference fitting.

Figure 2:
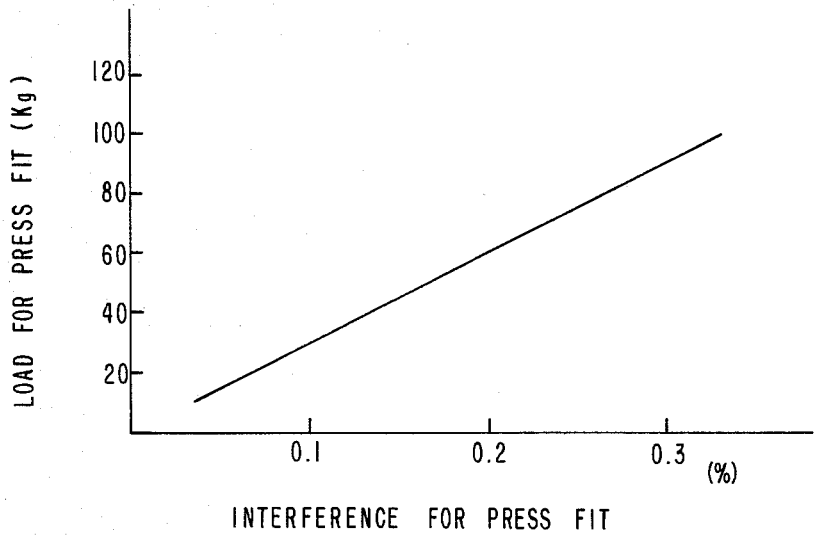
FIG. 2 is a graphical view showing the relationship between the interference and the load applied to the tapered pins.

FIG. 2 shows the results of this testing, in which the axis of abscissas stands for the amount of expansion of the inner diameter (%) which is designated as an interference for press fitting for the purpose of convenience.

This graph then indicates that the load applied to the tapered pin has a proportional relation to the amount of expansion of the inner diameter by a factor of 300. It follows that a certain figure on one axis defines a relative figure on the other axis.

From the results of the foregoing preliminary testings, it is found that, when the inner part is inserted under pressure at its shaft into the opening of the outer part, it is very unlikely that, if the amount of expansion of the inner diameter (the interference for press or interference fitting) is within a certain critical range, the load applied for press fitting may exceed the rupture strength, thus leading to breaking-out or cracking of the outer parts.

From the data obtained in both testings, the critical range is expressed as a percent with respect to the inner diameter D, and defined by a calculation $((0.23T+1)D+13.8)/300$.

The absolute value for the interference is then obtained by multiplying the calculated value by D/100. Below the calculated value, no destruction or cracking of the outer part takes place, even when the inner part is inserted under pressure thereinto, so that satisfactory fitting of the inner part into the outer part is achieved.

The present invention will be further elucidated with reference to the following examples.

EXAMPLES

In accordance with the procedures of the aforesaid preliminary testings, hollow, cylindrical compacts having a density of 6.7 g/cm$^2$, a reference inner diameter of 30 mm, a thickness of 5 mm and a length of 5 mm and solid, cylindrical compact having reference outer diameter of 30 mm and a length of 40 mm were prepared as the outer and inner parts, respectively, from powdery mixtures of atomized iron powders with 1,5% of copper powders and 0,7% of graphite powders.

Suitable sets of the inner and outer parts were prepared such that certain differences in fitting size were obtained, and divided into two series, one showing minus differences in fitting size and the other plus difference in fitting size. The term "minus" or "plus" is understood to indicate shrink fit (wherein the inner shafts have a diameter larger than those of the outer openings) or running fit (wherein the outer openings have a diameter of those of the inner shafts).

In the one series of the inner and outer parts according to the present invention, press fitting was applied while, in the other series, shrink fitting was applied for the purpose of comparison; the inner parts were fitted into the openings of the outer parts which were heated to expand the inner diameter thereof. To unite the inner parts to the outer parts, sintering was carried out at 1130° C. for 30 minutes in a sintering furnace in which a modified butane gas was filled.

To determine the strength of the thus obtained composite sintered bodies, the outer parts thereof were fixed at the head of a material testing machine through a spacer, and a gradually increasing load was axially applied to the inner parts. Measurements were then made on the strength of the inner and outer parts the moment that they broke, and taken as the joining strength of the composite compacts.

Figure 3:
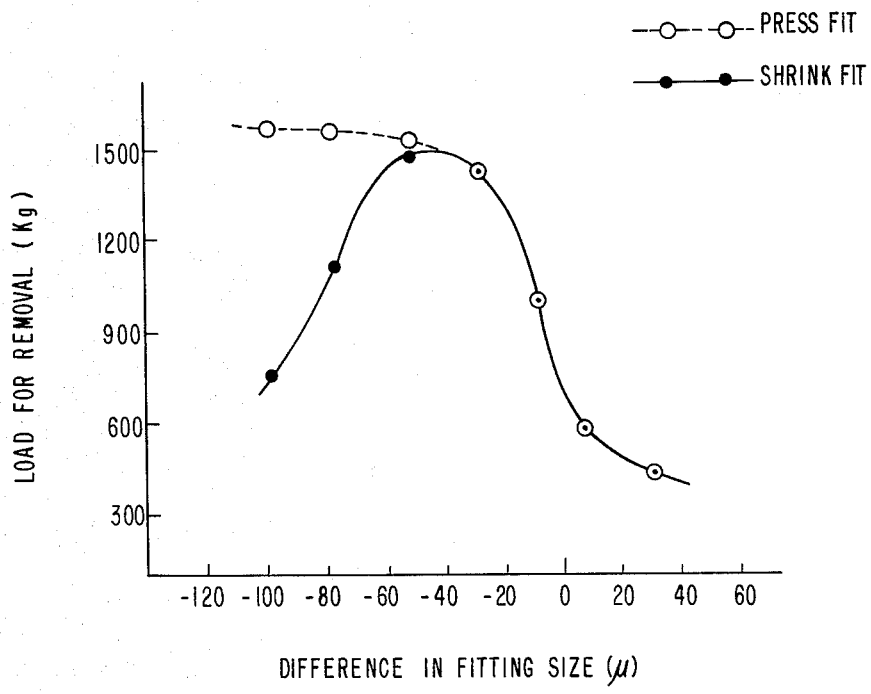
FIG. 3 is a graphical view showing the relationship between the joining strength and the differences in fitting size between composite compacts.

Experimental results are graphically shown in FIG. 3, in which a dotted line passing through ○ indicates the present system wherein press fitting is applied, and a solid line passing through ● the prior art system wherein shrink fitting is applied. Figures of the experimental results represented in the graph in FIG. 3 are shown in Table I.

As will be apparent from this graphical view, the substantially same strength for removal, i.e., joining strength, is obtained, when the difference in fitting size ranges from plus 30 microns (running fit) to minus 60 microns (shrink fit). However, when the difference in fitting size ranges from minus 60 microns to minus 100 microns, there is a steep drop in the joining strength in the case of shrink fit, while there is a slight improvement in the joining strength in the case of press fit.

The reason is considered to be that, in the shrink fit system, the larger the interference in interference fit, the higher the heating temperature will be so as to expand the inner diameter more largely. Such high-temperature heating causes surface oxidation of the outer part, which inhibits diffusion of metal during sintering, with the result that the joining strength of the inner and outer parts decreases.

With the press fitting system, however, such disadvantages as mentioned above are not incurred, since it is carried out at normal temperature. Due to the fact that use is made of an interference larger than applied in the prior art, sintering is done in a state wherein the inner part comes into closer contact with the outer part, so that satisfactory diffusion of metals takes place, resulting in improvements in the joining strength.

Figure 4:
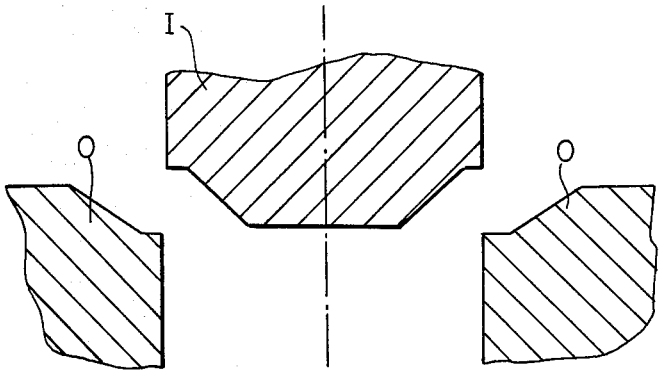
FIG. 4 is a view showing part of the prior art chamfered composite compacts.
Figure 5:
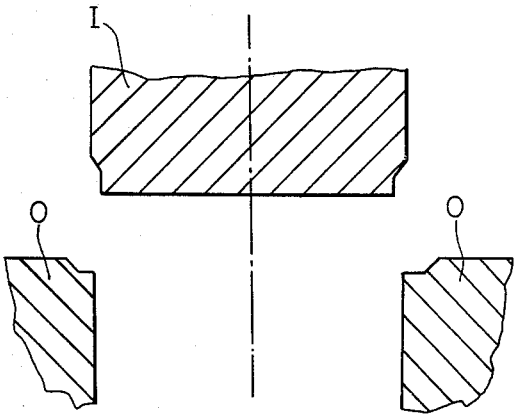
FIG. 5 is a view showing part of the chamfered composite compacts according to the present invention.

It is noted that it is desired to make the outer diameter of the end portion of the inner I slightly smaller than the inner diameter of the outer part 0 and to provide the inner part with a tapered step over a certain range of the end portion thereof, as illustrated in FIG. 5. This is because difficulty is involved in press fitting of the inner part into the outer part in a conventionally chamfered state, as depicted in FIG. 4.

As described in detail in the foregoing, the present invention makes it possible to use a wider interference, so that productivity is improved with an increase in the joining strength of the sintered composite bodies.

TABLE I

| Press Fit | | Shrink Fit | |
|---|---|---|---|
| Interference | Strength | Interference | Strength |
| −99μ | 1580 kg | −98μ | 760 kg |
| −79 | 1570 | −77 | 1130 |
| −52 | 1540 | −52 | 1510 |
| −30 | 1430 | −30 | 1430 |
| −9 | 1010 | −9 | 1010 |
| +6 | 590 | +6 | 590 |
| +30 | 420 | +30 | 420 |

What is claimed is:

1. In a process for making a sintered mechanical part with a complex profile by preparing separately an inner compact having a shaft and an outer compact having an opening by the compression of iron-based metal powders, and sintering both compacts in a state where the inner compact is fitted into the outer compact, the improvement which comprises:

pressfitting the shaft of the inner compact into the opening of the outer compact with an interference fit to form said mechanical part without exceeding the rupture strength of said outer compact, and wherein the percent of interference in relation to the inner diameter of the opening of the outer compact is not higher than the value $(0.23T+1D+1.38)/300$ wherein D is the inner diameter of the opening in the outer compact in millimeters and T is the wall thickness of the outer compact in millimeters, and subsequently sintering said mechanical part.

2. The process of claim 1, wherein the shape of the outer compact is cylindrical.

* * * * *